US005613418A

United States Patent [19]

Guido

[11] Patent Number: 5,613,418

[45] Date of Patent: Mar. 25, 1997

[54] MULTIPLE-STAGE HYDRAULIC CYLINDER

[75] Inventor: Heinz Guido, Duisburg, Germany

[73] Assignee: MAN Gutehoffnungshütte Aktiengesellschaft, Oberhausen, Germany

[21] Appl. No.: 562,306

[22] Filed: Nov. 22, 1995

Related U.S. Application Data

[63] Continuation of Ser. No. 142,446, Jan. 10, 1994, abandoned.

[30] Foreign Application Priority Data

Mar. 25, 1992 [DE] Germany ..... 42 09 649.9

[51] Int. Cl.[6] ..... F15B 11/18; F01B 7/20

[52] U.S. Cl. ..... 91/167 R; 92/52; 92/53

[58] Field of Search ..... 92/51, 52, 53; 91/167 R; 60/480

[56] References Cited

U.S. PATENT DOCUMENTS

| | | | |
|---|---|---|---|
| 2,829,499 | 4/1958 | Ferguson et al. . | |
| 3,213,765 | 10/1965 | Knable . | |
| 3,269,275 | 8/1966 | Waite . | |
| 3,957,125 | 5/1976 | Russell . | |
| 4,523,512 | 6/1985 | Hessel et al. | 92/53 X |
| 4,881,211 | 11/1989 | Myers | 91/167 R X |
| 4,928,488 | 5/1990 | Hunger | 91/167 R X |
| 4,936,193 | 6/1990 | Stoll | 92/53 X |

FOREIGN PATENT DOCUMENTS

| | | | |
|---|---|---|---|
| 209497 | 7/1957 | Australia | 92/53 |
| 0479651 | 9/1991 | European Pat. Off. . | |
| 1478447 | 4/1967 | France . | |
| 2321820 | 8/1974 | Germany . | |
| 2626606 | 12/1977 | Germany . | |
| 3615269 | 11/1987 | Germany . | |
| 109806 | 8/1980 | Japan | 92/51 |
| 0043206 | 3/1984 | Japan | 92/52 |

*Primary Examiner*—Hoang Nguyen
*Attorney, Agent, or Firm*—Max Fogiel

[57] ABSTRACT

A multiple-stage hydraulic cylinder for shifting loads by exerting different forces over different distances, in which a hollow-piston cylinder is provided with a hollow piston rod. The hollow piston rod accommodates at least one additional long-stroke cylinder. The hollow piston rod, moreover, comprising a cylinder tube surrounding the long-stroke cylinder. Connections are provided for hydraulic fluid to move the cylinders. These connections are provided on the hollow piston rod and the long-stroke cylinder for admitting fluid to move the hollow-piston cylinder and the long-stroke cylinder.

6 Claims, 4 Drawing Sheets

MULTIPLE-STAGE HYDRAULIC CYLINDER

The present invention is a continuation of the parent application Ser. No. 142,446 filed Jan. 10, 1994 now abandoned.

BACKGROUND OF THE INVENTION

The present invention concerns both a multiple-stage hydraulic cylinder and a method of using such a cylinder to shift loads by subjecting them to different forces (counter-forces) over different distances.

Multiple-stage hydraulic cylinders for shifting loads are basically known. Generic telescoping cylinders as recited in the preamble to Claim 1, however, have a drawback in that, in addition to the space occupied by the cylinder itself, they require additional space for the mechanisms they rest on. Furthermore, all the components of the cylinder must be able to sustain the force generated by every specific stage of the cylinder. When there is a wide difference between the various stages, this peculiarity necessarily complicates the design of the overall cylinder.

SUMMARY OF THE INVENTION

The object of the present invention is a multiple-stage hydraulic cylinder that is simple in design, occupies little space, can shift various levels of load over strokes of different length, and can be manufactured more cost-effectively than conventional cylinder of the genus.

This object is attained in accordance with the present invention as recited in the accompanying claims.

The multiple-stage hydraulic cylinder in accordance with the invention can accordingly generate high pressure accompanied by a short stroke during an initial stage. This initial stage is in principle the stage that occurs in a known cylinder when the load is stacked against a hollow piston. The hollow piston in accordance with the invention, however, simultaneously constitutes one section of a multiple-stage telescoping cylinder accommodated inside it.

Pressure against the connector accommodated in the first stroke stage in this embodiment shifts a heavy load during the initial motion of the stroke. This load comprises the physical load multiplied by a prescribed breakaway moment. The breakaway moment is overcome upon termination of the shorter stroke during the first stroke stage, and only the load itself remains to be shifted. The corresponding stroke stages II and III are for this purpose subjected to pressure at the fluid connection. The piston in the present embodiment travels all the way up to the load and intercepts it. Stages II and III then travel out and shift the load into its ultimate position.

When the stroking cylinder, which can be three-stage for example, travels back or down, only weak countervailing forces or loads need to be accommodated and shifted into the desired final position.

Such a multiple-stage hydraulic cylinder can for example be employed as a three-stage stroke system in a direct-current arc furnace to shift a worn or burned-out electrode weighing 26 tonnes out of the refractory-clad floor into the furnace itself.

The force applied during the first stage of the overall three-stage system may need to be as powerful as 100 tonnes in order to loosen the electrode, sintered and forced in as it is, and lift it approximately 300 mm. Once the electrode has been released from the floor, it can be lifted an additional approximately 2000 mm by the two inner cylinders (stages II and III) into a position where it can be intercepted by other lifting mechanisms, a crane for example, and lowered to a maintenance or repair site in the steel mill,

BRIEF DESCRIPTION OF THE DRAWINGS

Embodiments of the invention will now be described with reference to the accompanying drawing, wherein.

DESCRIPTION OF THE PREFERRED EMBODIMENTS

Figure 1:
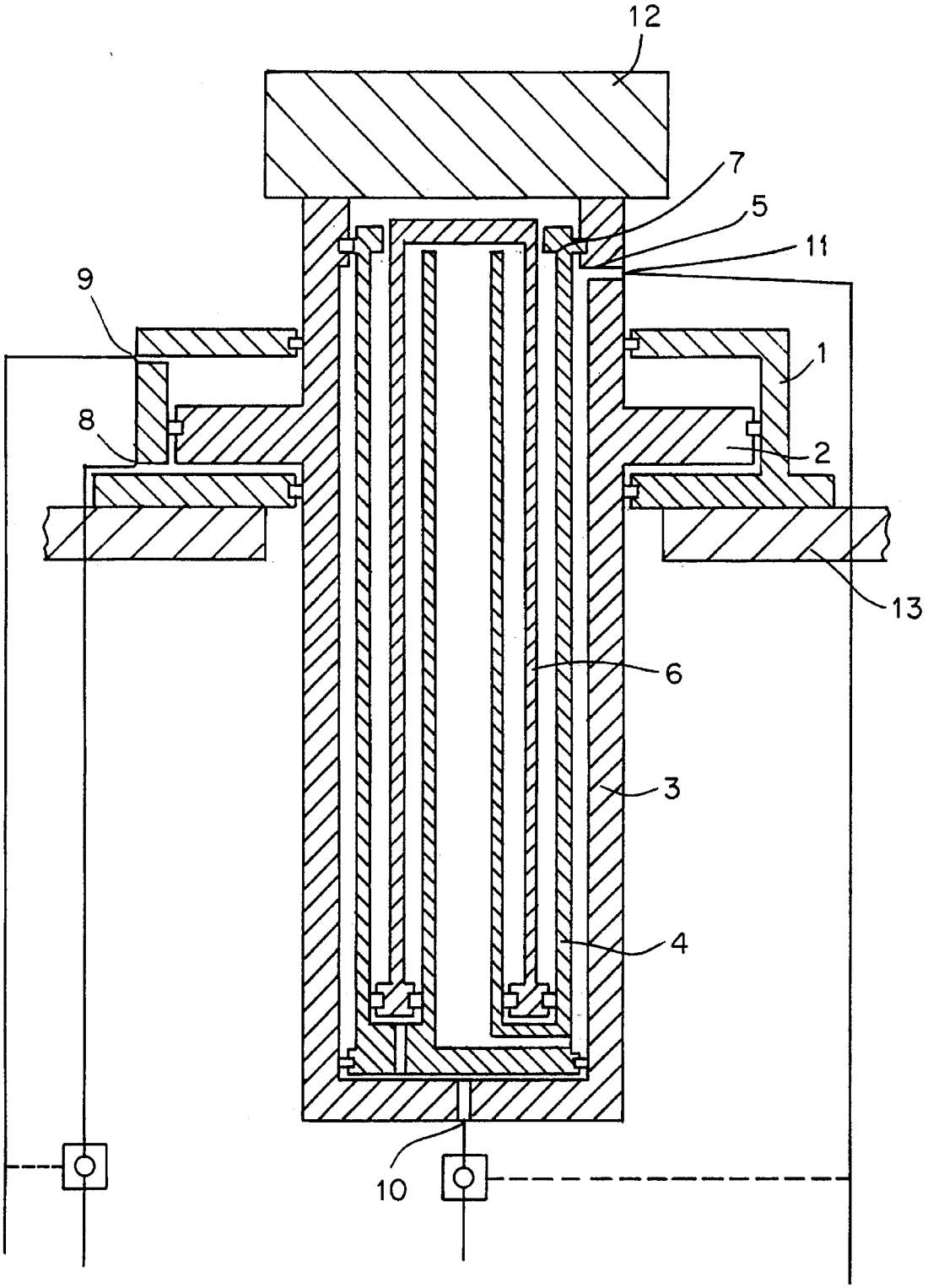
FIG. 1 is a section through a collapsed three-stage lifting cylinder.
Figure 2:
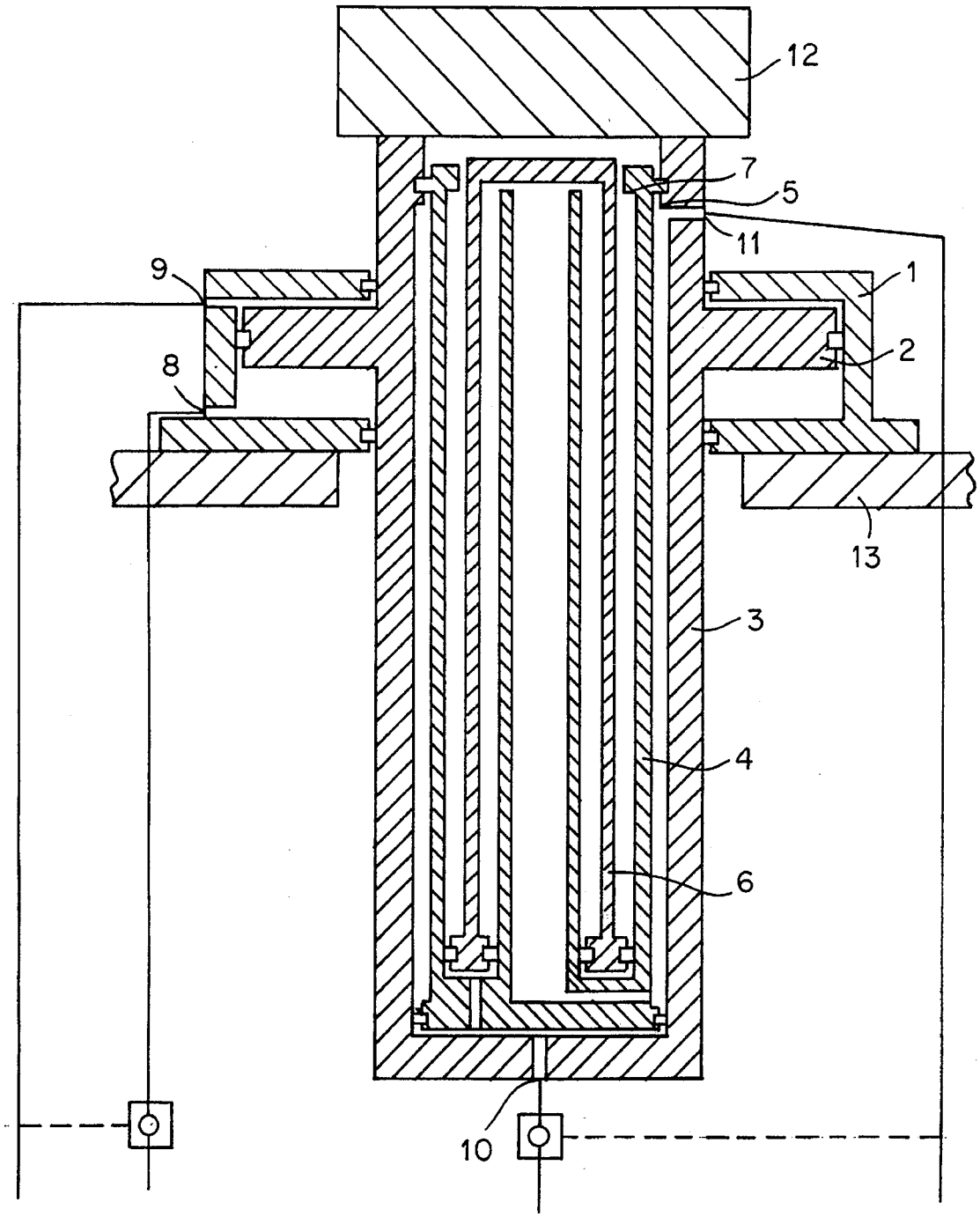
FIG. 2 is a section through the same cylinder extended to Stage I.
Figure 3:
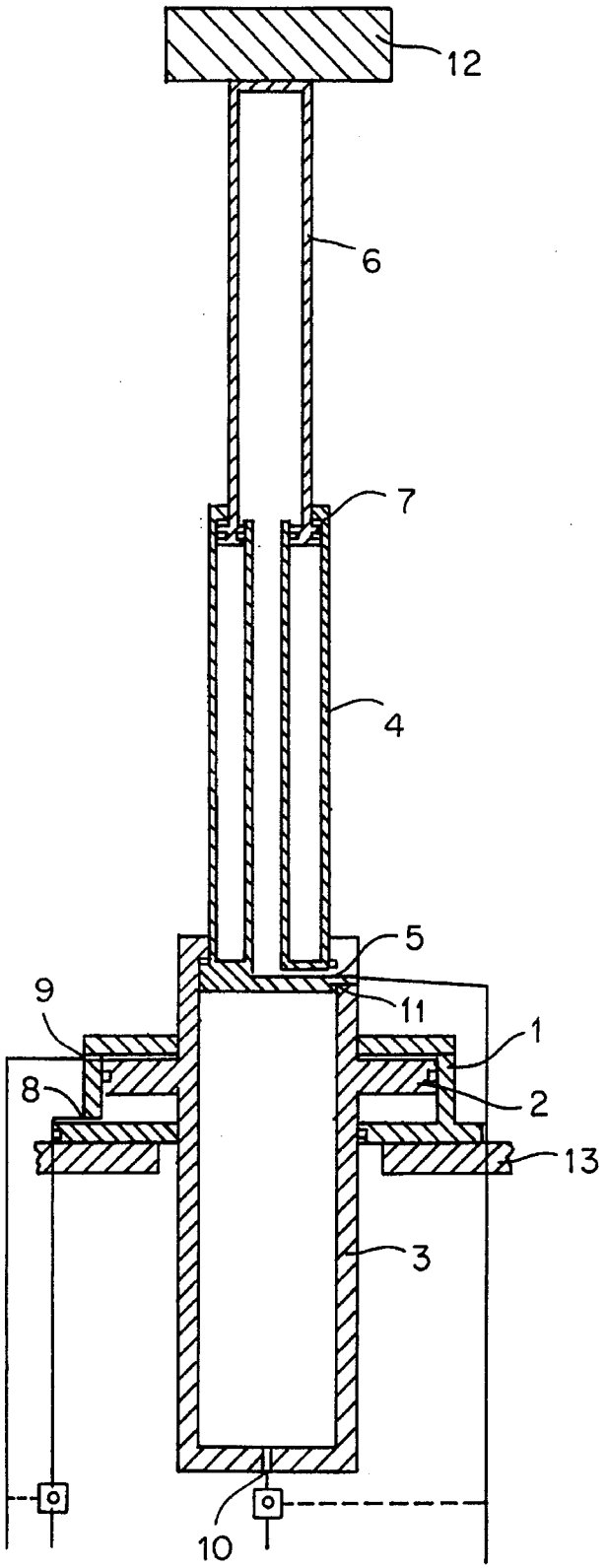
FIG. 3 is a section through the same cylinder extended all the way out.

The three-stage hydraulic cylinder illustrated in FIGS. 1 through 3 comprises an initial Stage I in the form of a hollow-piston cylinder with a cylinder tube 1, a piston 2, and a piston rod 3.

The hollow piston rod 3 accommodates a telescoping cylinder in the form of two long-stroke cylinders 4 and 6.

Hollow piston rod 3 accommodates a stop 5 that limits the stroke traveled by telescoping cylinder 4 that constitutes Stage II Telescoping piston 4 itself accommodates a stop 7 that limits the stroke traveled by a telescoping cylinder 6 that constitutes Stage III.

Mounted on cylinder tube 1 are connections 8 for the hydraulic fluid employed to raise Stage I, and other connections 9 for the fluid employed to lower it. Similar connections 10 and 11 for the fluid employed for Sitages II and III are located below hollow piston rod 3 (for raising) and beside the top of hollow piston rod 3 (for lowering).

The Stage I cylinder can rest on a stationary support 13.

FIG. 1 I illustrates the three-stage lifting cylinder collapsed.

It will be evident from FIG. 2 that hollow piston rod 3 can be extended up to constitute Stage I.

FIG. 3 illustrates the three-stage lifting cylinder fully extended, meaning that long-stroke cylinders 4 and 6 are completely raised, FIGS. 1 through 3 generally indicate how the hydraulic cylinder in accordance with the invention can be employed for lifting and lowering a load 12. The device in accordance with the invention can of course basically be employed as well for moving loads in other directions.

Figure 4:
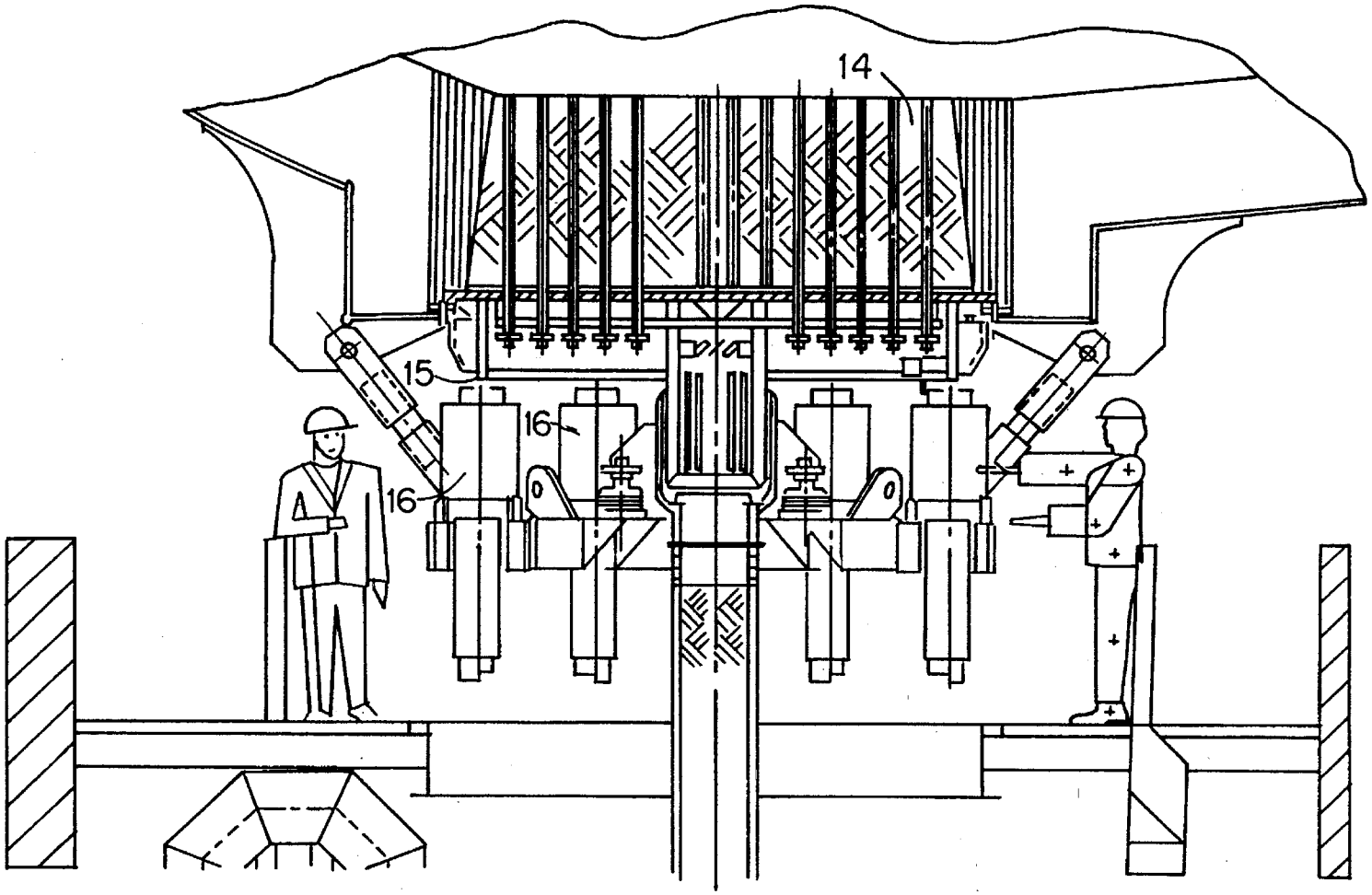
FIG. 4 illustrates how the cylinder can be positioned below an electrode in the floor of a direct-current arc furnace.

FIG. 4 represents a practical example using a three-stage lifting system to force an electrode out of the floor of a direct-current arc furnace as hereintofore described.

Electrode 14 is located in the hearth of a direct-current arc furnace. Worn electrodes are replaced with fresh or reconditioned components. Multiple-stage cylinders 16 are distributed around the electrode and below the furnace. Cylinders 16 rest against the base 15 of electrode 14. The electrode, which weighs approximately 26 tonnes, is initially subjected to a powerful countervailing force by hollow-piston cylinders 1, 2, and 3.

This force loosens the electrode from the surrounding refractory material of the floor of the furnace. The long-stroke cylinders now lift the electrode with less force into the interior of the furnace. The worn electrode can now be intercepted by a gripping tool and removed from the furnace.

The ratio of effective surface of the hollow piston cylinder 1 to effective surface of the long-stroke cylinder 4 can be in the range of 2:1 to 5:1.

In summary, the connections to the hollow-piston rod and the long-stroke cylinder admit fluid to move the hollow-piston cylinder and the long-stroke cylinder. The hollow-piston rod is a second telescopic section in stage 1 of the three pressure stages, and displaced by the hollow-piston cylinder in a first telescopic section. The load on stage 1 rests against a head of the second telescopic section and is shifted by the second telescopic section only. The second telescopic section accommodates on its inside the long-stroke cylinder as a third telescopic section when the long-stroke cylinder is inoperative and retracted. The longstroke cylinder is operative in stages 2 and 3 of the 3 stages, and is inoperative until the load in stage one is to be grasped and raised.

Thus, the load is shifted by subjecting it to different forces exerted over different distances by the multiple-stage hydraulic cylinder. To shift the load 12, for example, the hollow-piston cylinder 1, 2, 3 is initially supplied with enough fluid to generate a force powerful enough to release the load, and the long-stroke cylinder 4 or cylinders 4, 6 are then supplied with enough fluid to shift the load into its final position.

List of components

1.cylinder tube, Stage I
2. piston, Stage II
3. hollow piston rod
4. telescoping piston, Stage II
5. stroke-limiting stop, Stage II
6. telescoping cylinder, Stage III
7. stroke-limiting stop, Stage III
8. lifting hydraulic-fluid connection, Stage I
9. lowering hydraulic-fluid connection, Stage I
10. lifting hydraulic-fluid connection, Stages II and III
11. lowering hydraulic-fluid connection, Stages II and III
12. load
13. support
14. electrode in floor of a direct-current arc furnace
15. base of electrode 14
16. multiple-stage hydraulic cylinder

We claim:

1. A multiple-stage hydraulic cylinder with a support attached thereto and with three different pressure stages for shifting loads by exerting different forces over different distances to lift a bottom electrode out of a direct-current arc furnace, comprising: a hollow-piston cylinder with a hollow piston rod; a long-stroke cylinder in said hollow piston rod, said hollow piston rod also comprising a cylinder tube surrounding said long-stroke cylinder; and connections on said hollow piston rod and said long-stroke cylinder for admitting fluid to move said hollow-piston cylinder and said long-stroke cylinder, said hollow piston rod being a second telescopic section in stage one of said three pressure stages and displaced by said hollow-piston cylinder in a first telescopic section, said load in said stage one resting against a head of said second telescopic section and being shifted by said second telescopic section only, said second telescopic section accommodating inside thereof said long-stroke cylinder as a third telescopic section when said long-stroke cylinder is inoperative and retracted, said long-stroke cylinder being operative in stages two and three of said three stages and being inoperative until said load in stage one is to be grasped and raised, said multiple-stage hydraulic cylinder comprising a three-stage hydraulic cylinder with two separately operating pressure systems in form of a high pressure system and a low pressure system.

2. A multiple-stage hydraulic cylinder as defined in claim 1, wherein said long-stroke cylinder inside said hollow piston rod is a multiple-stage telescoping cylinder.

3. A multiple-stage hydraulic cylinder as defined in claim 1, wherein a ratio of effective surface of said hollow-piston cylinder to effective surface of said long-stroke cylinder is in the range of 2:1 to 50:1.

4. A multiple-stage hydraulic cylinder as defined in claim 1, wherein the connections for fluid moving said hollow-piston cylinder are separate from the connections moving the long-stroke cylinder.

5. A multiple-stage hydraulic cylinder with a support attached thereto and with three different pressure stages for shifting loads by exerting different forces over different distances to lift a bottom electrode out of a direct-current arc furnace, comprising: a hollow-piston cylinder with a hollow piston rod; a long-stroke cylinder in said hollow piston rod, said hollow piston rod also comprising a cylinder tube surrounding said long-stroke cylinder; and connections on said hollow piston rod and said long-stroke cylinder for admitting fluid to move said hollow-piston cylinder and said long-stroke cylinder, said hollow piston rod being a second telescopic section in stage one of said three pressure stages and displaced by said hollow-piston cylinder in a first telescopic section, said load in said stage one resting against a head of said second telescopic section and being shifted by said second telescopic section only, said second telescopic section accommodating inside thereof said long-stroke cylinder as a third telescopic section when said long-stroke cylinder is inoperative and retracted, said long-stroke cylinder being operative in stages two and three of said three stages and being inoperative until said load in stage one is to be grasped and raised; said long-stroke cylinder inside said hollow piston rod being a multiple-stage telescoping cylinder; a ratio of effective surface of said hollow-piston cylinder to effective surface of said long-stroke cylinder being in the range of 2.1 to 5.1; said connections for fluid moving said hollow-piston cylinder being separate from the connections moving the long-stroke cylinder, said multiple-stage hydraulic cylinder comprising a three-stage hydraulic cylinder with two separately operating pressure systems in form of a high pressure system and a low pressure system.

6. A method for shifting loads by exerting different forces over different distances by a multiple-stage hydraulic cylinder with a support attached thereto and with three different pressure stages to lift a bottom electrode out of a direct-current arc furnace, comprising the steps of: providing a hollow-piston cylinder with a hollow piston rod and a long-stroke cylinder in said hollow piston rod surrounding also said long-stroke cylinder; admitting fluid through connections on said hollow piston rod and said long-stroke cylinder to move said hollow piston cylinder and said long-stroke cylinder, said hollow piston rod being a second telescopic section in stage one of said three pressure stages; displacing said hollow piston rod by said hollow-piston cylinder in a first telescopic section; resting said load in said stage one against a head of said second telescopic section; shifting said load by said second telescopic section only, said second telescopic section accommodating inside thereof said long-stroke cylinder has a third telescopic section when said long-stroke cylinder is inoperative and retracted, said long-stroke cylinder being operative in stages two and three of said three stages and being inoperative until said load in stage one is to be grasped and raised, said multiple-stage hydraulic cylinder comprising a three-stage hydraulic cylinder with two separately operating pressure systems in form of a high pressure system and a low pressure system.

* * * * *